US005540558A

United States Patent [19]

Harden et al.

[11] Patent Number: 5,540,558

[45] Date of Patent: Jul. 30, 1996

[54] APPARATUS AND METHOD FOR ELECTRONICALLY CONTROLLING INLET FLOW AND PREVENTING BACKFLOW IN A COMPRESSOR

[75] Inventors: William H. Harden, Yadkinville; John T. Gunn, Charlotte, both of N.C.

[73] Assignee: Ingersoll-Rand Company, Woodcliff Lake, N.J.

[21] Appl. No.: 512,379

[22] Filed: Aug. 7, 1995

[51] Int. Cl.[6] ..... F04B 49/00

[52] U.S. Cl. ..... 417/53; 417/295; 251/82; 251/129.19

[58] Field of Search ..... 417/295, 53; 251/82, 251/129.19, 129.11, 129.04

[56] References Cited

U.S. PATENT DOCUMENTS

| | | | |
|---|---|---|---|
| 2,040,964 | 5/1936 | Tarleton . | |
| 2,961,147 | 11/1960 | Osterkamp | 417/295 X |
| 4,052,135 | 10/1977 | Shoop et al. . | |
| 4,396,345 | 8/1983 | Hutchinson . | |
| 4,523,436 | 6/1985 | Schedel et al. . | |
| 4,919,390 | 4/1990 | Ichiryu et al. . | |
| 4,945,941 | 8/1990 | Kocher | 251/82 X |
| 4,968,218 | 11/1990 | Koivula et al. . | |
| 4,968,221 | 11/1990 | Noll | 417/295 |
| 5,018,947 | 5/1991 | Tsuboi | 417/295 |
| 5,163,477 | 11/1992 | Takano et al. | 251/129.19 X |
| 5,388,968 | 2/1995 | Wood et al. . | |

FOREIGN PATENT DOCUMENTS

| | | | |
|---|---|---|---|
| 6-129385 | 5/1994 | Japan | 417/295 |

*Primary Examiner*—Richard E. Gluck
*Attorney, Agent, or Firm*—Michael M. Gnibus

[57] ABSTRACT

An apparatus for electronically controlling the flow of low pressure gas to a compressor and preventing backflow from the compressor, the apparatus including a housing in fluid communication with the compressor, where the housing has a chamber, a housing inlet for receiving a low pressure gas, and a housing discharge port for flowing the low pressure gas to the compressor and through which backflow gas flows from the compressor. A valve member having a contact end is movable within the chamber along a predetermined path. The apparatus also includes a drive for moving an actuator along an axis. The actuator has an extension with an end adapted to abut the contact end of the valve member to thereby move the valve member along the path toward the housing inlet. The valve member is movable along the path and away from the inlet, when the actuator is retracted, by the flow of low pressure gas through the inlet. Upon compressor shutdown, the back pressure moves the valve member to a substantially occluding position relative to the inlet position to prevent backflow from flowing outward from the compressor.

22 Claims, 6 Drawing Sheets

APPARATUS AND METHOD FOR ELECTRONICALLY CONTROLLING INLET FLOW AND PREVENTING BACKFLOW IN A COMPRESSOR

BACKGROUND OF THE INVENTION

This invention generally relates to a compressor inlet valve, and more particularly to a compressor inlet valve for electronically controlling inlet gas flow and preventing backflow through the compressor inlet.

In order to control the throughput or capacity of a compressor, a compressor typically includes an inlet valve which regulates the compressor capacity. One type of inlet valve is commonly referred to as an unloader valve because the valve is used to load and unload the compressor. The compressor is loaded when the inlet valve is open permitting fluid, such as air, to flow through the compressor inlet. The compressor is unloaded when the valve is closed thereby "choking" or blocking the flow of fluid through the compressor inlet.

Unloader valves may be opened and closed pneumatically. Pneumatically controlled unloader valves require a regulation air system for operation. Although the pneumatically controlled unloader valves have operated with varying degrees of success, there are problems associated with such valves. When the compressor is operated in temperatures that are below freezing, the regulation air system may freeze and render the inlet valve inoperable. Additionally, the regulation air system requires regular maintenance in order to ensure that the air system can effectively actuate the unloader valve during compressor operation. This regularly conducted maintenance can be time consuming and may render the compressor inoperable when it is being performed.

Unloader valves may also be opened and closed hydraulically. Hydraulic unloader valves frequently leak hydraulic fluid and require replacement of parts, such as diaphragms, for example.

A problem associated with compressors, especially oil-flooded screw compressors, is backflow through the compressor inlet. Such backflow is comprised of a combination of a gas, such as air, and oil. Backflow occurs when the compressor is stopped while the compressor system is pressurized. It is undesirable to permit backflow to be released into the environment because of the loss of oil from the system and associated contamination of the environment. One conventional way of preventing backflow is by inserting check valves in the air service and oil injection lines. Conventional check valves are spring actuated to permit unidirectional flow of compressed gas or oil, away from the compressor. In this way, backflow is prevented by the check valves. Although current check valves are effective in preventing backflow, it would be more desirable to prevent backflow without introducing additional discrete valves into the system. The addition of the discrete check valves increases the cost and complexity of the compressor. In hydraulically and pneumatically operated unloader valves, the backflow may be used to close the unloader inlet. However, the tendency to freeze, problems with leaking oil and hydraulic fluid and required maintenance make hydraulically and pneumatically operated unloaders undesirable.

Electronically operated inlet valves typically include a stepper motor that is connected to a disc or piston that is movable by the motor. A pressure sensor measures compressor discharge pressure, generates a signal in response to the measured pressure and communicates the signal to a controller. In response to the signal generated by the sensor, the controller calculates the distance that the disc or piston needs to be moved to obtain the desired discharge pressure and rotates the stepper motor in short, discrete angular movements to thereby move the disc or piston the calculated distance. Typically, the disc or piston when fully closed, does not seal the inlet well enough to prevent backflow of oil. To date, compressors with electrically actuated inlet valves do not seal against backflow and require that a discrete check valve be inserted in a compressed air service line, typically located downstream from the compressor discharge port along with another check valve, known in the art as an oil stop valve, located in an oil injection line. These valves increase the cost and complexity of the compressor.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an apparatus and method for electronically controlling the flow of low pressure gas to a compressor and preventing backflow from the compressor, said apparatus comprising a housing in fluid communication with said compressor, said housing having a chamber, a housing inlet for receiving a low pressure gas, and a housing discharge port for flowing said low pressure gas to said compressor and through which backflow gas flows from said compressor. A valve member having a contact end, is movable within the housing chamber along a predetermined path defined by an axis. A drive means for moving an actuator along a path, said actuator having an end adapted to abut said contact end of said valve member to thereby move the valve member along the path toward the housing inlet. The valve member is movable along the path away from the inlet by said low pressure gas and is movable to a substantially occluding position relative to the housing inlet by backflow gas and without moving said actuator.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION OF THE PREFERRED EMBODIMENT

Figure 2:
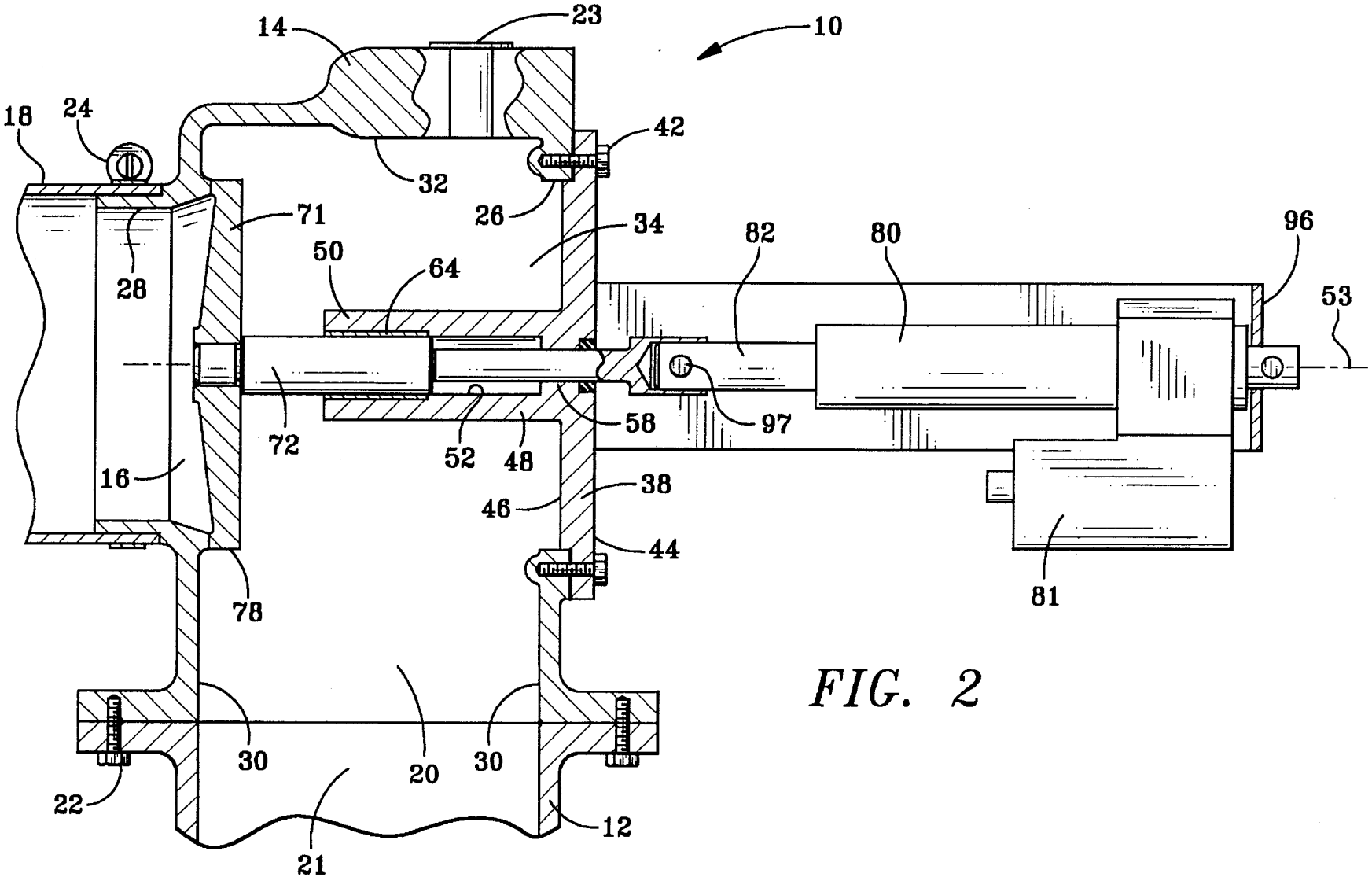
FIG. 2 is a longitudinal sectional view of the inlet valve of the present invention showing the valve member in a substantially occluding position.

Referring now to the drawings, wherein similar reference characters designate corresponding parts throughout the several views, FIG. 2 illustrates compressor inlet valve 10 for a gas compressor 12. The inlet valve serves both to regulate the throughput or capacity of the compressor and also to prevent backflow in the compressor. Hereinafter for clarity, backflow shall mean any gas or gas/oil combination. Valve 10 replaces discrete check valves in the service and oil lines of compressed air systems well known in the art. Conventional discrete check valves prevent backflow in known compressed air systems. The inlet valve is in fluid communication with compressor 12. In the preferred embodiment, the inlet valve is used in combination with an oil-flooded, rotary screw compressor. However the inlet valve may also be used in combination with a non-lubricated rotary screw compressor. The compressor includes compressor inlet 21 and discharge port 25.

Figure 3:
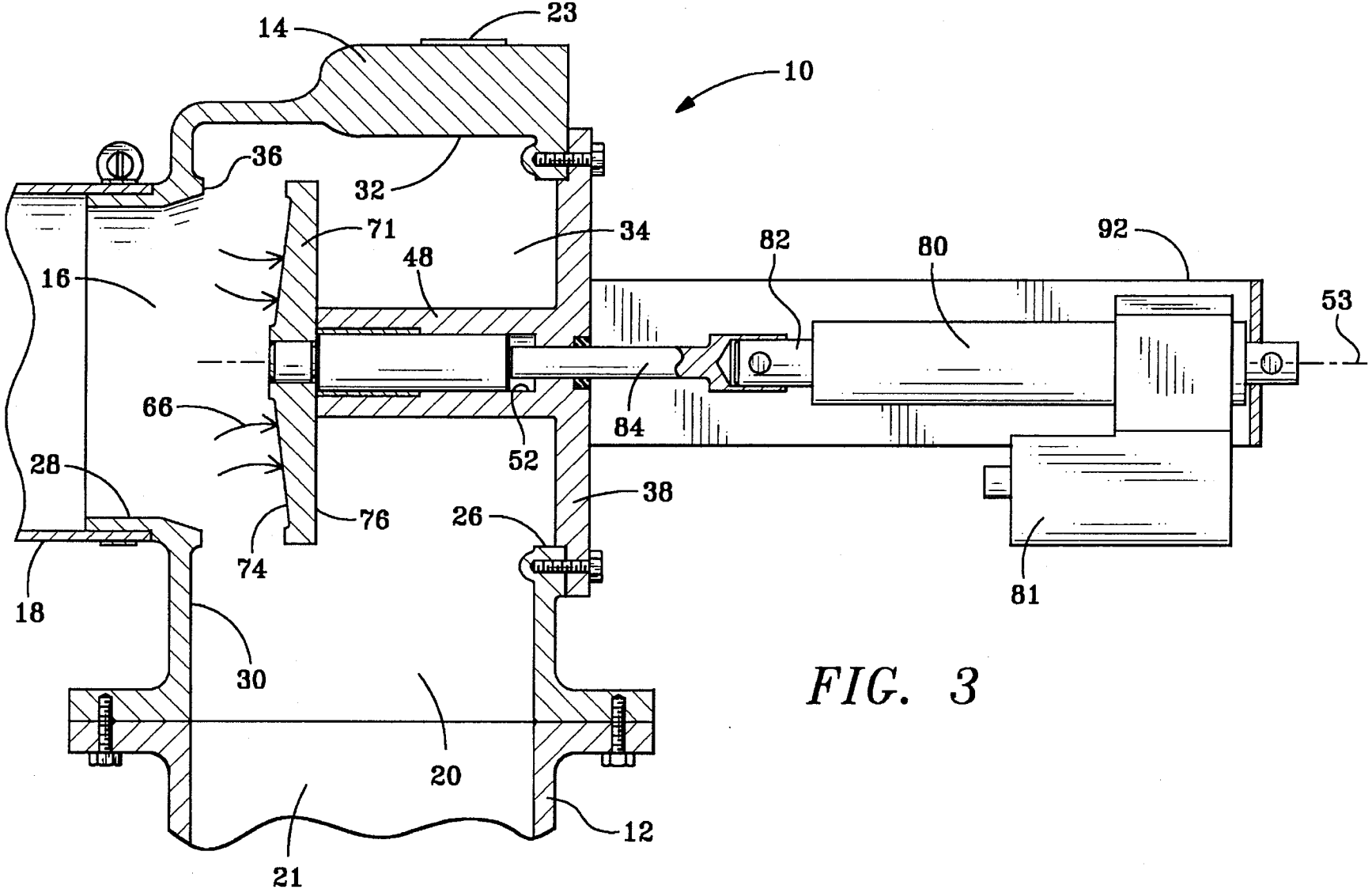
FIG. 3 is a longitudinal sectional view of the inlet valve of the present invention showing the valve member in a substantially non-occluding position.

As shown in FIGS. 2 and 3, inlet valve 10 includes inlet housing 14 which has a housing inlet 16 which communicates with inlet ducting 18, a housing discharge port 20 which is flow connected to compressor inlet 21 by conventional connection means 22, and anti-rumble gas inlet 23. The anti-rumble inlet must extend through the housing at a location away from housing inlet 16 as shown in FIG. 2. Inlet ducting 18 is connected to housing inlet 16 by a conventional clamping apparatus 24. Housing 14 also includes housing opening 26, which extends through the housing opposite the housing inlet.

First interior surface 28 defines the housing inlet through which low pressure gas such as air flows into the housing. Second interior surface 30 defines the housing discharge port through which the low pressure gas exits the inlet valve housing and flows to the compressor and through which backflow flows from the compressor. Third interior surface 32 defines a substantially cylindrical inlet chamber 34 which fluidly communicates with housing inlet 16 and discharge port 20. The housing inlet is surrounded by valve seat 36 which extends away from inlet 16 towards inlet chamber 34 as shown in FIG. 3.

Figure 4:
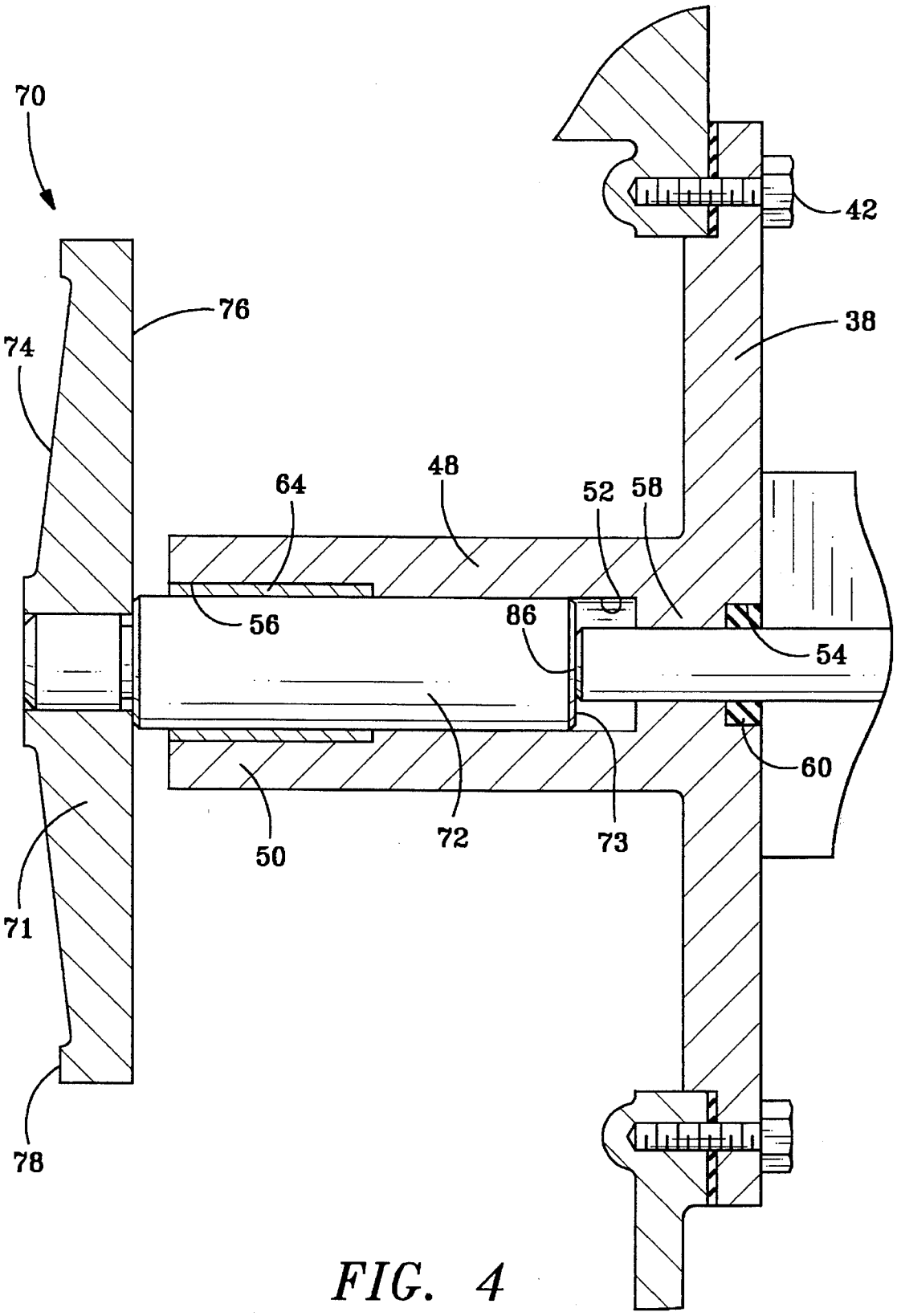
FIG. 4 is an enlarged view of the valve member shown in FIG. 2 with the valve member at a position between the occluding and non-occluding positions.

Mounting plate 38 is adapted to be seated in housing opening 26. As shown in FIG. 4, a conventional gasket member is sandwiched between the periphery of the mounting plate and the housing 14, when the plate is secured to the housing by conventional fasteners 42. The mounting plate has a first face 44 and a second face 46. Guide member 48 is made integral with mounting plate 38 along second face 46. When the mounting plate is seated in opening 26, the guide member is located within inlet chamber 34 with guide member free end 50 positioned away from housing opening 26 and second face 46 facing inlet chamber 34.

Bore 52, extends along longitudinal axis 53, through the guide and plate and has discrete lengths with different diameters. The discrete diameters of bore 52 are shown in FIG. 4. Bore 52 forms an opening 54 on first plate face 44 and also forms an opening 56 at guide member free end 50.

As shown in FIG. 4, seal 60, such as a lip seal, is disposed in the portion of bore 52 between shoulder 58 and opening 54, and bushing 64 is disposed in the bore at free end 50 of guide member 48.

Valve member 70 is movable, relative to the guide member, within housing chamber 34 and along a predetermined path defined by axis 53. The path has a first limiting position where the valve member is in a substantially occluding position relative to housing inlet 16, see FIG. 2, and a second limiting position where the valve member is in a substantially non-occluding position relative to the housing inlet, see FIG. 3.

The valve member includes a poppet 71 and a valve stem 72 which is threadably connected to the poppet so that the stem and poppet are movable together within chamber 34 and along the predetermined path. The valve stem is located in bore 52 and includes a contact end 73 which is positioned within bore 52 near shoulder 58. The poppet and valve stem are movable linearly along the predetermined path. Additionally, during operation of the compressor, in order to obtain the desired compressed gas discharge pressure, the valve member may be located at any location along the predetermined path, between the first and second limiting positions.

Poppet 71 includes a leading face 74, a trailing face 76 and a valve stop 78 along the periphery of the leading face of the poppet. The stop is adapted to abut housing seat 36 in the manner shown in FIG. 2 when the valve is in the substantially occluding position.

Drive 80 is a linear actuator that replaces the pneumatic and hydraulic drives and stepper motors that are well known in the art. The linear actuator includes a direct current (DC) powered electric motor 81 that extends and retracts an actuator 82 along axis 53. Conventional gearing provides the required gear ratios (typically 10:1) between the actuator and the motor. The actuator thrust is provided using a ball screw mechanism that is known in the art. In the preferred embodiment, the linear drive is designed to provide at least 1000 pounds of thrust to the actuator 82. The linear drive may be of the type manufactured by Warner Electric Corporation which provides at least 1000 pounds of actuator thrust force. Hereinafter, the terms linear actuator or linear drive shall mean an apparatus having a motor that displaces an actuator member linearly when power is supplied to the motor.

The linear actuator is in communication with controller 100 which is described in detail hereinafter.

Figure 5:
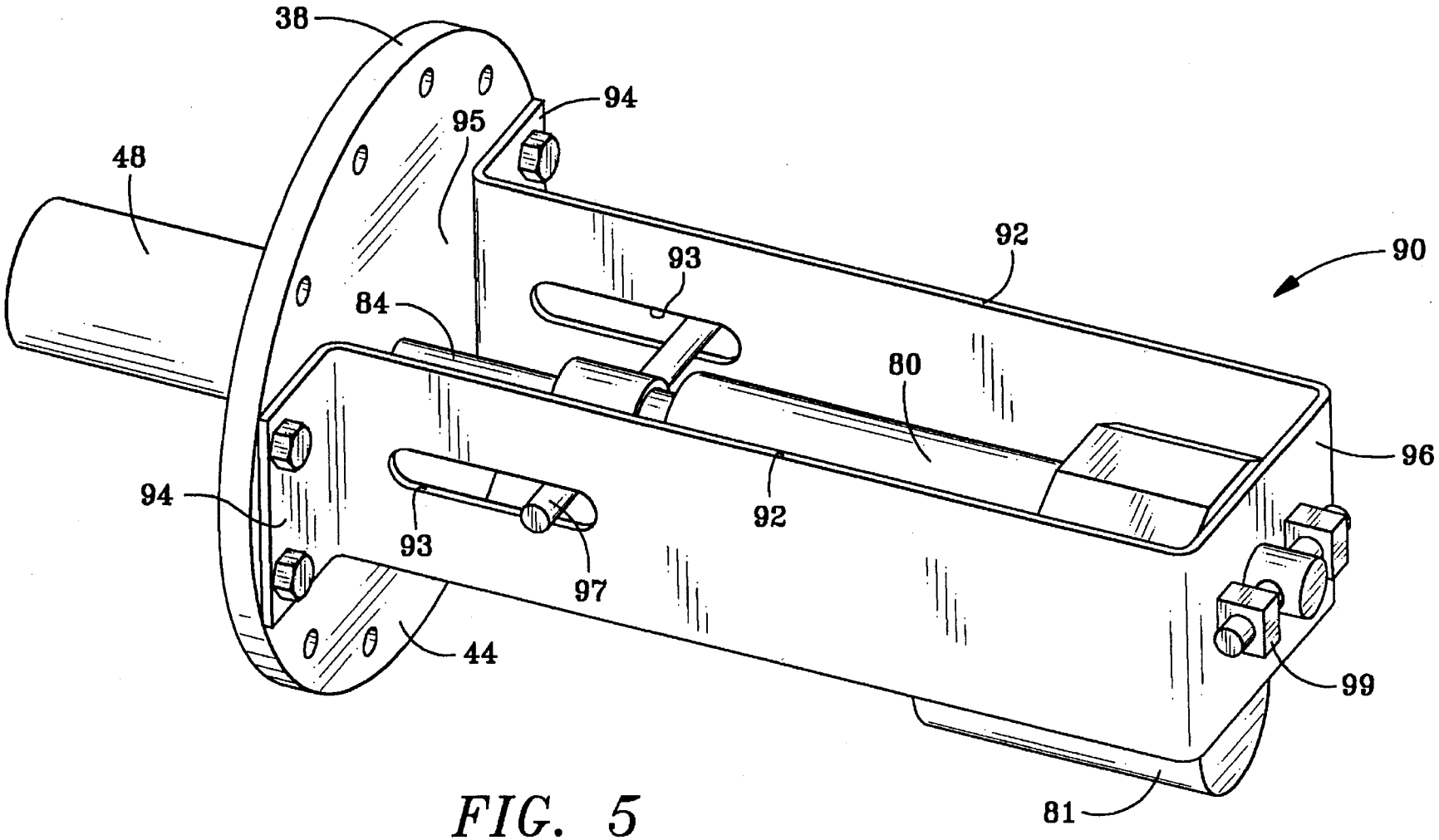
FIG. 5 is an enlarged isometric view of the linear drive shown in FIG. 2.

As shown in FIG. 5, bracket 90 supports the linear actuator 80 and encloses a portion of actuator extension 84. The actuator extension is connected to the end of actuator 82 and is moveable linearly, along axis 53 with the actuator. The bracket includes an open end 95, a closed end 96, sidewalls 92 having longitudinal slots 93, and flange portions 94 at the open end. The flanges are mounted, in a conventional manner, on first face 44 of mounting plate 38. The actuator extension is connected to the actuator 82 by an antirotation pin 97 the respective ends of which are located in slots 93 to be movable linearly in the slots during extension and retraction of the actuator and actuator extension. In this way, the pin prevents rotation of the actuator during operation. Lugs 99 are mounted on closed end 96 and are adapted to receive the ends of a second pin, like pin 97. In this way, rotation and displacement of rear portion of linear actuator 80 is prevented.

The actuator extension contact end 86 is adapted to abut contact end 73. Actuator extension 84 extends through bracket open end 95 to a location within bore 52 with actuator extension end 86 located immediately proximate or in abutment with valve stem contact end 73.

The valve stem and actuator extension are not connected. Therefore, when it is necessary to close the valve, the actuator and actuator extension are together extended and moved toward the inlet 16 and the actuator extension end 86 abuts valve stem end 73 and by this abutment, urges valve member 70 along the predetermined path, toward inlet 16. However, since the stem and valve are not connected, when the actuator extension and actuator are retracted and moved away from inlet 16, the actuator extension does not pull valve member 70 away from inlet 16. Rather, as the actuator extension is withdrawn, the gas drawn through the housing inlet flows against the poppet contact face 74, as indicated by arrows 66 in FIG. 3, and forces the valve member away from inlet 16 along the predetermined path, keeping contact end 73 in abutment with contact end 86.

Figure 6:
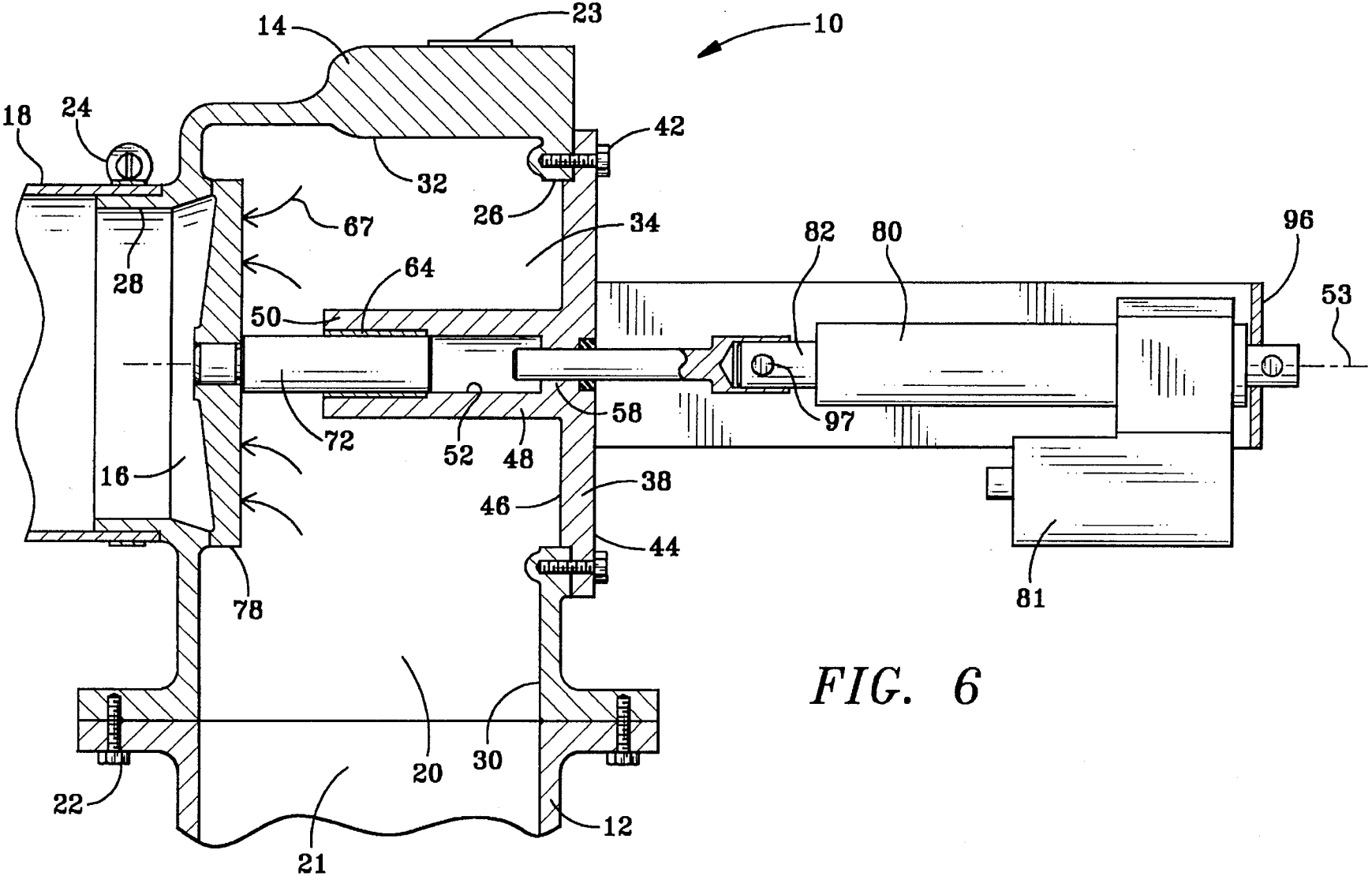
FIG. 6 is a longitudinal sectional view of the inlet valve of the present invention with the valve member located in the substantially occluding position by backflow.

Additionally, when backflow flows through compressor inlet 21 and housing discharge port 20, the gas flows against poppet trailing face 76, as indicated by arrows 67 in FIG. 6, and rapidly forces the valve member toward the inlet 16, to the substantially occluding position shown in FIG. 2, thereby closing the housing inlet and preventing backflow from exiting the housing. As shown in FIG. 6, when the valve member is closed by backflow, contact end 73 is moved out of abutment with end 86.

Pressure sensing means 98 is located in pressure sensing communication with separator tank 104 and senses the discharge pressure of the compressed gas. Additionally, the sensing means generates a signal in response to the discharge pressure sensed by the pressure sensing means. As shown schematically in FIG. 1, the pressure sensing means is in signal transmitting communication with controller 100 so that the generated signal is communicated to the controller. The sensing means may be a pressure transducer or the like.

Figure 1:
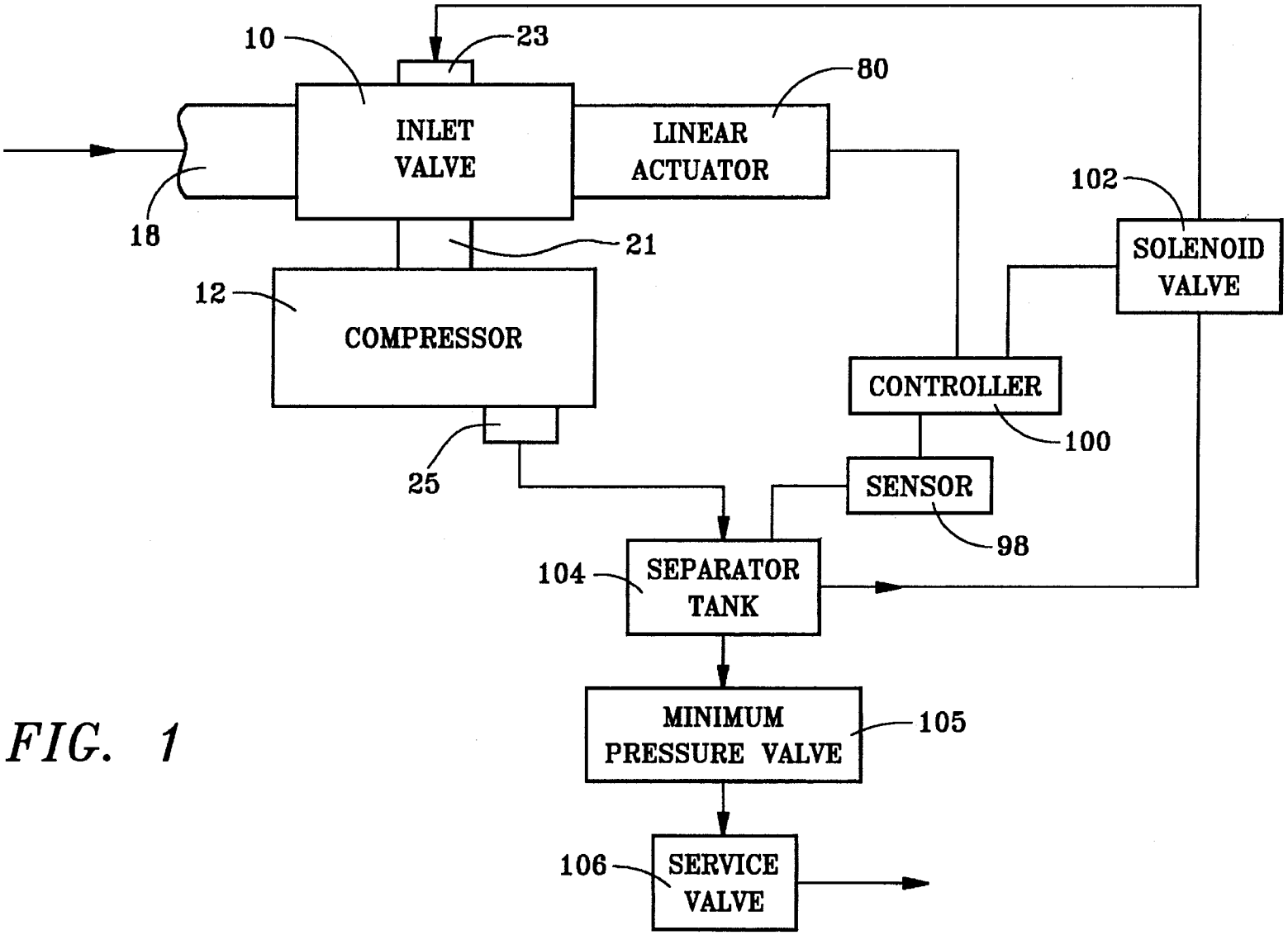
FIG. 1 is a schematic diagram including the apparatus of the present invention.

Also shown in FIG. 1, electronic microprocessor based controller 100 is located in signal receiving relation with respect to pressure sensing means 98, and is located in both signal transmitting and receiving relation with respect to linear actuator 80. The controller is located in signal transmitting relation to solenoid valve 102.

A desired operational discharge pressure for a specific application, hereinafter referred to as "set point" pressure is programmed in the logic stored in the controller. The set point pressure represents the desired compressor discharge pressure. Also programmed in the controller is a variable deadband pressure range. The deadband range represents the acceptable pressure range which includes the set point pressure. For example, if the set point pressure is 115 psi, and the acceptable variation in the set point pressure is +/−5 psi, the acceptable pressure range or deadband range would be 110 psi to 120 psi.

A conventional separator tank 104 is in fluid communication with the compressor discharge port and serves to separate a fluid, such as oil, from the compressed gas. The essentially dry gas flowing from the tank may flow to the customer via a service valve 106 or may be redirected to the anti-rumble inlet 23. Solenoid valve 102 is flow connected to separator tank 104. When valve member 70 is in a substantially occluding position, the solenoid is actuated by the controller and opens the anti-rumble valve permitting gas exiting the tank to be reflowed to the compressor inlet and in this way, prevent vibration of the rotors referred to in the art as rumble condition. A minimum pressure valve 105 is in flow communication with the interior of the separator tank. The minimum pressure valve maintains a minimum pressure in the tank in order to maintain oil flowing through the compressor.

In operation, a set point discharge pressure is entered into the controller where it is stored. The acceptable variation in the set point pressure is also entered and stored in the controller. Sensor 98 is located in pressure sensing communication with the interior of tank 104.

Valve member 70 is in a substantially occluding position when the compressor 12 is started. The actuator 82 is extended and contact end 86 of actuator extension 84 is in abutment with contact end 73 and thereby maintains the valve in the substantially occluding position shown in FIG. 2 during startup. The solenoid valve 102 is actuated by controller 100 thereby permitting anti-rumble gas to flow through anti-rumble inlet 23 to the compressor 12.

Solenoid valve 102 remains open until valve member 70 is opened. After the compressor has been started, and is warmed up, power is supplied to linear actuator motor 81 which retracts actuator 82 along axis 53 and away from the inlet 16. As the actuator extension is moved away from the inlet, gas drawn through inlet 16 acts against face 74, and the greater pressure on face 74, as compared to face 76, forces valve member 70 away from housing inlet 16. As valve member 70 is moved away from inlet 16, solenoid valve 102 is closed by the controller. The resultant pressure, representing the difference between the flow pressures acting on faces 74 and 76, moves the valve away from the inlet 16, until contact end 73 abuts end 86 of actuator extension 84.

The inlet vacuum in cavity 34 decreases as the inlet valve is opened as gas is drawn into the housing by the compressor.

The discharge pressure is continuously monitored by sensing means 98 which generates a signal in response to the sensed pressure and communicates the signal to controller 100. The controller executes a preprogrammed logic routine and compares the sensed pressure to the preprogrammed acceptable pressure range. The actuator is retracted until the discharge pressure is in the acceptable range. When the discharge pressure is in the acceptable range, the motor 81 is turned off by the controller and further displacement of the valve member away from inlet 16 is prevented by the stationary actuator extension 84. The linear actuator rapidly and accurately permits the valve member to move along the predetermined path to the position required to produce an acceptable discharge pressure. The proper position is determined by the measured discharge pressure. The proper position typically is located along the path between the occluding and non-occluding positions. The valve member is moved away from the inlet 16 when the pressure is below the acceptable range and it is necessary to increase the load to the compressor.

If the actuator reaches the end of travel so that the valve member is in the substantially non-occluding position of FIG. 3, the controller receives a locked rotor current from the linear drive, indicating the actuator has reached the end of travel. Then power to the DC motor is interrupted causing the motor to shut off. The locked rotor current includes a direction signal which indicates the direction of travel of the actuator to the controller. In this way the controller microprocessor can determine electronically if the valve member has reached the end of travel in the non-occluding or occluding position.

If, during compressor operation, the discharge pressure measured by sensing means 98, is above the preprogrammed acceptable pressure range, and it is necessary to move the valve member toward inlet 16, the controller supplies power to motor 81 which extends actuator 82 and simultaneously moves the actuator extension along axis 53, toward inlet 16. The contact end 86 of the actuator extension abuts the contact end 73 and thereby urges the valve member along the predetermined path of movement toward the inlet. The pressure sensor continuously monitors discharge pressure in the manner previously described and the actuator is extended until the discharge pressure falls into the acceptable pressure range, at which time the controller interrupts power to the motor. The actuator provides a thrust that is of sufficient magnitude to overcome the pressure of the gas or air drawn into the housing inlet.

If, during operation, the valve member reaches the substantially occluding position shown in FIG. 2 a locked rotor current like the locked rotor current previously described is transmitted from the linear actuator and is received by the controller. When the locked rotor current is received by the controller, the supply of power to the motor is interrupted and solenoid valve 102 is opened permitting anti-rumble air to compressor 12.

Movement of the valve member is determined solely by the discharge pressure of the compressor. The valve member 70 is opened or closed based on the measured compressed gas discharge pressure. Based on the measured discharge pressure, the valve member may be moved along the predetermined path and located at the occluding position, the non-occluding position or at a position along the path therebetween.

When the compressor is stopped, backflow will flow from the compressor out compressor inlet 21. If valve member 70 is open, the backflow flows against trailing face 76 of the valve member in the manner indicated by arrows 67 in FIG. 6. The backflow rapidly moves the valve into the substantially occluding position shown in FIG. 6. The higher pressure on face 76, as opposed to face 74, closes the valve member. In this way, the flow of oil and gas from the compressor and out the housing inlet is prevented. When the valve member is forced shut by the backflow, ends 73 and 86 are moved out of abutment. The two ends remain out of abutment until the compressor is turned on, gas is again drawn through the housing inlet and the valve member is forced away from the inlet in the manner previously described.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

Having described the invention, what is claimed is:

1. An apparatus for controlling the flow of low pressure gas to a compressor and preventing backflow from the compressor, said apparatus comprising:

a) a housing in fluid communication with said compressor, said housing having a chamber, a housing inlet for receiving low pressure gas, and a housing discharge port for flowing said low pressure gas to said compressor and through which backflow flows from said compressor;

b) a valve member having a contact end, said valve member movable within said chamber toward and away from said inlet along a first path, said path having a first limiting position where said valve member is disposed in a substantially occluding relationship relative to said housing inlet and a second limiting position where said valve member is disposed in a substantially non-occluding relationship relative to said housing inlet said valve member movable away from said inlet by said low pressure gas; and c) drive means for moving an actuator along a second path, said actuator having an end adapted to abut said contact end of said valve member and thereby move said valve member toward the inlet, said valve member also movable to the substantially occluding position by said backflow to thereby prevent backflow from flowing outward from the compressor;

d) means for sensing the pressure of the gas discharged from the compressor and generating a signal in response to the pressure of the discharged gas; and e) electronic controller means operatively connected to said drive means and disposed in signal receiving communication with said sensing means to thereby control movement of said actuator in response to the signal generated by said sensing means.

2. The apparatus as claimed in claim 1, wherein said drive means is a linear drive having a motor, said actuator operatively connected to said motor, and a linear actuator extension connected to said actuator, said actuator and extension movable together linearly by said motor along said second path.

3. The apparatus as claimed in claim 2, wherein said housing includes a housing opening opposite said housing inlet, the apparatus further comprising a stem connected to said valve member, a mounting plate adapted to be seated in said housing opening and a guide member integral with said plate, said guide member and plate including a bore that extends through said plate and guide, said bore adapted to slidably receive said valve stem and said actuator extension.

4. The inlet valve as claimed in claim 1 further including antirotation means for preventing rotation of said actuator during movement of said actuator.

5. The apparatus as claimed in claim 2, further comprising a bracket supporting said linear drive, said bracket including an open end, a closed end and a pair of sidewalls between said ends each sidewall having a slot formed therein, said antirotation means comprising an antirotation pin having a pair of ends, each of said ends slidably located in one of said slots.

6. The apparatus as claimed in claim 5, wherein said antirotation means includes lugs mounted on said bracket closed end, said lugs adapted to receive a second antirotation pin to prevent rotation and displacement of said linear drive.

7. The apparatus as in claim 1, wherein said pressure sensing means is a pressure transducer and is located in pressure sensing communication with a separator tank.

8. The apparatus as in claim 1, wherein said valve member is movable linearly along said first path, and said valve member includes a leading face, a valve stop located along the leading face, a trailing face and a valve stem, said contact end at one end of the valve stem.

9. The apparatus as claimed in claim 1, wherein the housing includes anti-rumble inlet.

10. The apparatus as claimed in claim 1, wherein said drive means is a linear actuator.

11. A combination comprising:

A) a gas compressor; and

B) an inlet valve for controlling flow of gas to said compressor and preventing backflow from said compressor, said inlet valve comprising;

1) a housing in fluid communication with said compressor, said housing having a chamber, a housing inlet for receiving a low pressure gas, and a housing discharge port for flowing said low pressure gas to said compressor and through which backflow gas flows from said compressor;

2) a valve member having a contact end, said valve member movable within said chamber along a predetermined path which includes a first limiting position where said valve member is disposed in a substantially occluding relationship relative to said housing inlet and a second limiting position where said valve member is disposed in a substantially non-occluding relationship relative to said housing inlet;

3) drive means for extending and retracting an actuator along a second path, said actuator having an end adapted to abut said contact end of said valve member to thereby move said valve member toward the housing inlet, said valve member movable away from the inlet by the flow of said low pressure gas, said valve member movable to the substantially occluding position, in response to backflow from the compressor to thereby prevent backflow from the compressor, without extending or retracting said actuator.

12. The combination as claimed in claim 11 wherein said drive means is a linear actuator.

13. The combination as claimed in claim 11 wherein said drive means is a linear drive having an electric motor, linear drive actuator movable by the motor, the linear drive actuator is adapted to be connected to the actuator to be movable with the actuator.

14. Apparatus for controlling the flow of low pressure gas to a compressor and preventing backflow from the compressor, said apparatus comprising:

a) a housing in fluid communication with said compressor, said housing having a chamber, a housing inlet for receiving a low pressure gas, and a housing discharge port for flowing said low pressure gas to said compressor and through which backflow gas flows from said compressor;

b) a valve member having a contact end, said valve member movable within said chamber along a predetermined path, said path having a first limit where said valve member is disposed in a substantially occluding relationship relative to said housing inlet and a second limit where said valve member is disposed in a substantially non-occluding relationship relative to said housing inlet;

c) a linear drive for moving an actuator along a second path, said actuator having an end adapted to abut said contact end of said valve member to thereby move said valve member toward the housing inlet, said valve member movable away from the housing inlet by said low pressure gas, said valve member movable to the substantially occluding position by said backflow to thereby prevent backflow from the compressor without moving said actuator;

d) means for sensing the pressure of the gas discharged from the compressor and generating a signal in response to the pressure of the discharged gas; and e) electronic controller means operatively connected to said linear drive and disposed in signal receiving communication with said sensing means to thereby control movement of said actuator in response to the signal generated by said sensing means.

15. The apparatus as claimed in claim 14, further comprising an actuator extension connected to the actuator to be movable with the actuator along said second path.

16. A method for controlling the flow of inlet gas and preventing backflow in a compressor where said compressor is flow connected to an apparatus comprising a housing having a chamber, a housing inlet for receiving low pressure gas, a housing discharge port for flowing said low pressure gas to the compressor and for receiving backflow from the compressor; a valve member movable within said chamber along a path having a first limit where said valve member is in a substantially occluding position relative to the inlet and a second limit where said valve member is in a substantially non-occluding relationship relative to said inlet; and means for moving the valve member toward said substantially occluding position said means having an actuator movable toward and away from said valve member, said method comprising the following steps:

a) starting the compressor and drawing low pressure gas into the compressor through said housing;

b) measuring the discharge pressure of the compressed gas;

c) determining if the discharge pressure falls within an acceptable pressure range;

d) moving said valve member towards the housing inlet if the discharge pressure is outside the acceptable pressure range and is indicative of a decreased demand for low pressure gas, by actuating said means to move the valve member;

e) moving said valve member away from the housing inlet if the discharge pressure is in the acceptable pressure range and is indicative of an increased demand for low pressure gas, by moving said actuator away from said valve member and flowing low pressure gas through said inlet and against said valve member forcing the valve member away from said inlet; and f) if backflow is present in said chamber, using said backflow to move the valve member to the substantially occluding position.

17. The method as claimed in claim 16 including the step of locating a sensor in pressure communication with a separator tank before performing step b).

18. The method as claimed in claim 16 including the step of loading a set point pressure and deadband pressure range in a controller before step c).

19. The method as claimed in claim 16 wherein said means for moving said valve member is a linear actuator having a motor which drives said actuator, the method including the steps of: after step c) supplying power to said motor when the discharge pressure is not in the acceptable range and continuing to supply power to said motor until the discharge pressure is in the acceptable range.

20. The method as claimed in claim 16 wherein said housing includes a means for providing anti-rumble gas to the compressor, said method including the steps of actuating the anti-rumble means and flowing anti-rumble gas to the compressor when the valve member is in the substantially occluding position.

21. The method as claimed in claim 16 including the step of transmitting a locked rotor current by said drive means when the valve member is in either of the limiting positions.

22. The method as claimed in claim 21 including the step of actuating a solenoid valve and flowing anti-rumble gas to the housing when the valve member is in the substantially occluding position.

* * * * *